US006161596A

United States Patent [19]

Swers et al.

[11] Patent Number: 6,161,596

[45] Date of Patent: Dec. 19, 2000

[54] DECORATIVE OUTDOOR FABRICS

[76] Inventors: David N. Swers, 1602 Skye Dr., Chapel Hill, N.C. 27516; Johnny E. Parrish, 106 Wycombe Dr., Anderson, N.C. 29621

[21] Appl. No.: 09/525,285

[22] Filed: Mar. 15, 2000

Related U.S. Application Data

[63] Continuation of application No. 09/222,529, Dec. 29, 1998.

[51] Int. Cl.[7] ..... D03D 15/00

[52] U.S. Cl. ..... 139/420 A; 139/420 R; 442/200

[58] Field of Search ..... 139/420 R, 420 A, 139/426 R; 442/150, 198, 200, 203, 208, 209; 28/115, 109, 107, 112, 220

[56] References Cited

U.S. PATENT DOCUMENTS

| | | | |
|---|---|---|---|
| 5,187,005 | 2/1993 | Stahle et al. | 442/208 |
| 5,190,809 | 3/1993 | Marissen et al. | 442/198 |
| 5,199,141 | 4/1993 | Trask et al. | 28/115 |
| 5,284,704 | 2/1994 | Kochesky et al. | 428/296 |
| 5,617,903 | 4/1997 | Bowen, Jr. | 139/383 A |
| 5,698,480 | 12/1997 | Geiman et al. . | |
| 5,712,209 | 1/1998 | Geiman et al. | 442/208 |
| 6,092,563 | 7/2000 | Swers et al. | 139/420 R |

*Primary Examiner*—John J. Calvert
*Assistant Examiner*—Robert H. Muromoto, Jr.

[57] ABSTRACT

A decorative outdoor fabric including a woven structure formed of acrylic warp yarns and at least some of the fill yarns comprising self-coating yarns formed of high melt and low melt yarn constituents. When the fabric is tentered, the low melt constituents melt and cross-flow to the other fibers in the fill and warp yarns. The warp yarns have deniers of at least 150 d and the fill yarns have deniers of at least 400 d resulting fabric achieves acceptable abrasion resistance, stability, and load recovery and hand without the need for a latex backing.

13 Claims, 2 Drawing Sheets

DECORATIVE OUTDOOR FABRICS

This application is a continuation of utility Application Ser. No. 09/222,529 filed Dec. 29, 1998.

FIELD OF THE INVENTION

The present invention relates to decorative outdoor fabrics and particularly to fabrics of the type having a relatively open structure , such as "sling" fabric for casual furniture. More particularly, the invention relates to an outdoor fabric formed of acrylic, polyester, olefin, or nylon effect yarns and compounded or composite self-coating yarns which impart to the fabric greater abrasion resistance, load/elongation recovery, firmer hand and weave stability without the application of a latex backing.

BACKGROUND OF THE INVENTION

Novelty or decorative weave fabrics are often characterized by long floats, resulting in a relatively open structure in which fabric stability is a problem. This occurs in shade applications and outdoor cushion upholstery. Other outdoor fabrics such as "sling" fabrics, and fabric for tents, awnings, and marine applications must have the additional characteristics of abrasion resistance, high strength and load/elongation recovery. Conventional decorative weave fabrics do not exhibit these characteristics without difficulty and expense. Because the fabrics typically are used for outdoor applications they should also be colorfast and non-yellowing. Meeting these requirements requires that the fabric have a prescribed degree of UV resistance.

Decorative weave fabrics, as previously manufactured, are prone to undergo weave stability problems because of their open structure and sometimes the rough use to which they are subjected. For example, the warp and fill yarns may tend to slip and sag and not maintain their desired parallel relationship; the fabric may also suffer from seam slippage and raveling. In the past, these open structures have either been formed of relatively stiff yarns; or else they have been formed of softer yarns which have been stabilized by applying a latex coating on the backside of the fabric. Utilization of a latex coating requires specialized machinery and, of course, extra cost for the latex material. Further, this approach requires slower tenter speeds and, occasionally, multiple passes of the fabric through the tenter to achieve proper coating. The resulting fabric is extremely stiff and has but one aesthetically acceptable side, thus limiting its applicability. In many applications, such as sling fabrics, awnings, and marine tops, both sides must be visible and colored. Further, in many applications, it is desirable to use a continuous lay down in the pattern cutting operation, wherein the fabric is folded to form multiple layers and cut. This exposes alternate sides in the finished products. A one-sided fabric, as is the case in latex backed fabrics, prohibits taking advantage of this fabrication technique.

In casual outdoor furniture, awning, and marine applications, both sides of the fabric are often exposed to the consumer and user. It will be readily apparent that in such applications, both sides of the fabric should be aesthetically appealing.

The problems described above have limited the use of soft yarns in the woven decorative fabrics, because such constructions have not been able to provide an economically feasible fabric capable of meeting the required performance standards without the use of the aforesaid latex backing or very heavy constructions. Thus, softer acrylic yarns have not been used as a "sling" fabric in the casual fabric market. The term "sling fabric" as used herein refers to a fabric typically woven utilizing PVC coated polyester or PVC/acrylic blends (alternating E/E and P/P) in the 500–1000 denier range. This fabric is woven and attached to the rigid frames which make up the casual furniture.

SUMMARY OF THE INVENTION

The present invention therefore is directed to a woven, more open outdoor fabric, formed of softer yarns than previously, yet a fabric that provides enhanced abrasion resistance, load/elongation recovery, weave stability, and allows a much broader variety of designs.

The decorative fabric of the present invention therefore includes a woven structure of warp and fill yarns in which at least some of the fill yarns are self-coating compounded or composite yarns formed of high melt and low melt yarn constituent as used herein the term "self-coating" means that, upon heating as in the tentering operation, the low-melt constituents melt and cross-flow to the other fibers or filaments in both the fill and warp yarns. The fill yarns have a denier of at least 400 d. The warp yarns used in the fabric of the present invention are conventional acrylic but could be polyester, olefin, or nylon and also have a denier of at least 150 d. The resulting fabric achieves an acceptable abrasion resistance, stability, and load recovery without the need for latex backing.

The self-coating yarns referred to hereinabove should comprise at least one-third of the fill yarns in the weave pattern. The resulting fabric achieves an abrasion resistance preferably of greater than 9000 double rubs, seam slippage of greater than 40 lbs., and load recovery of at least 95%. While the specifications above are preferable, acceptable fabrics can be, in some cases, realized in which the abrasion resistance is 6000 double rubs and the load recovery is 90%. Further, the yarn ends of the self-coating yarns demonstrate minimal or zero raveling.

It is therefore an object of the present invention to provide an improved decorative outdoor fabric suitable for use in tents, awnings, marine applications, and in outdoor furniture.

It is another object to the present invention to provide a fabric of the type described which may be formed principally of acrylic, polyester, olefin, or nylon yarns, and requires no latex backing.

Another object of the invention is to provide fabrics of the type described which, when formed by the same construction as previously known, achieve improvements in key specifications as a result of the use of the self-coating yarns.

Still another object of the invention is to provide decorative outdoor fabrics with lighter weight, more open weaves, and lower costs.

It is yet another object of the present invention to provide a fabric of the type described which can be a relatively open structure, and yet achieves comparable abrasion resistance, stability, and load recovery, as compared to outdoor fabric formed of other yarns or formed of acrylic yarns with latex backing.

BRIEF DESCRIPTION OF THE DRAWINGS

The above and other objects, features, and advantages of the present invention will become more apparent and will be readily appreciated from the following detailed description of the preferred embodiments of the invention, taken in conjunction with the accompanying drawings in which.

DESCRIPTION OF THE PREFERRED EMBODIMENTS

Figure 1:
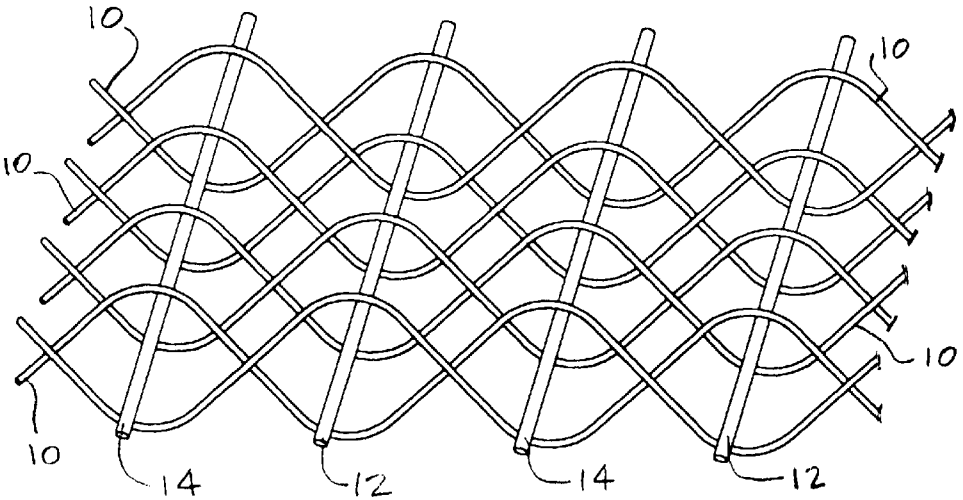
FIG. 1 is a schematic representation of a weave diagram illustrating a 1×1 pick pattern in which the self-coating yarn is provided in alternate fills.

The decorative fabric according to the present invention is formed of effect yarns and a stabilizing yarn. An "effect yarn" is a conventional yarn selected because of the effect it achieves in the fabric, and as aesthetics or hand. An example of an effect yarn is acrylic. The term "stabilizing" yarn is used herein to mean a yarn that achieves a utilitarian result encompassing such characteristics as abrasion resistance, load recovery or weave stability. The stabilizing yarn is in reality a unique self-coating yarn comprising both low melt and high melt constituents. The term "low melt" constituent is intended to mean fibers or filaments having a melt temperature in the range of 240–280° F. The term "high melt" constituent is intended to mean fibers or filaments having a melt temperature at least 40°–60° F. higher than the melt temperature of the low melt constituent with which it is intended to be used. Thus, if the melt temperature of the low melt constituent is 260° F., the high melt constituent should be selected to have a melt temperature of at least 310° F.

The high melt fibers or filament in the stabilizing yarn is preferably acrylic, although polyester, nylon or such olefins as polypropylene could also be used. The low melt constituent is preferably polyethylene, polypropylene or other low melt olefins. The composite yarn formed preferably includes deniers in the range of 400–4000 d.

The resulting yarn provides a fabric that is extremely abrasion resistant and will meet standards of up to and exceeding 9,000 double rubs. Further, such yarns create a fabric that is extremely resistant to slippage. By the term "slippage resistant," it is meant that fabrics formed from such yarns, when subjected to an Instron slippage test will be able to withstand forces of 40 lbs. and greater without seam slippage, whereas conventionally known decorative outdoor fabrics made without a latex backing and without the self-coating yarns can only withstand about 20 lbs. of force. Also, such fabrics will realize load recovery (dimensional stability) to 95% and greater, whereas conventionally formed fabrics can only achieve about 80% load recovery.

The composite or compounded yarns may be formed in either of two ways. A continuous low melt core can be combined with one or more ends of continuous filament high melt outer effect yarns with the ends be air textured. Alternatively, low melt and high melt stable fibers may be homogeneously blended or mixed, then processed according to standard blended yam forming procedures. In either technique, the amount of low melt constituent should be in the range of 10%–50% of the entire weight of the yarn. While the higher percentages (20%–50%) induce more cross-flow and binding of fibers and filaments exhibit greater abrasion resistance, weave stability, and load recovery, they adversely effect hydrostatic resistance in yarns formed by the blending of staple fibers method and therefore are used for outdoor fabrics. On the other hand yarns of lower percentages (10–15%) of low melt constituents as are used in the yarns formed of blended staple fibers, are utilized in tents, awnings, and marine applications because they must be more and are water repellant. These lower levels will not adversely affect hydrostatic resistance.

Figure 2:
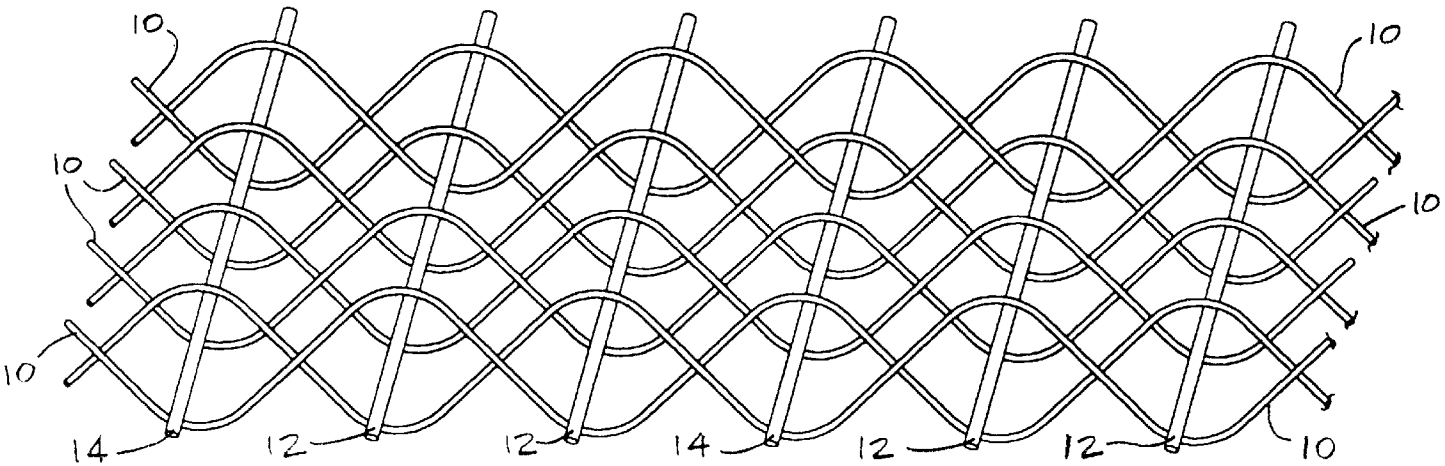
FIG. 2 is a schematic representation similar to FIG. 1 except illustrating a 1×2 pick pattern in which the self-coating yarn is used in every third fill.
Figure 3:
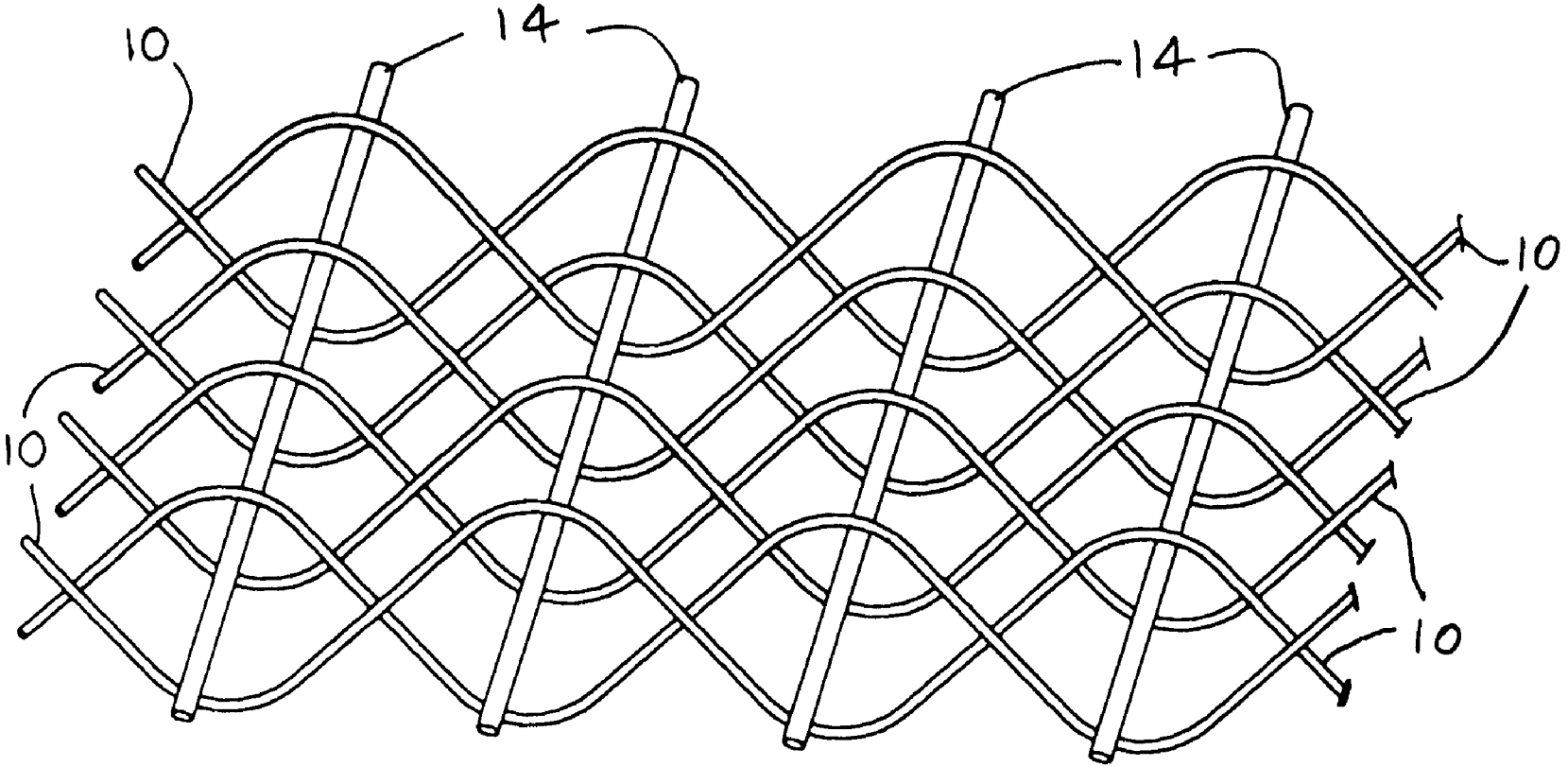
FIG. 3 is a schematic representation in which the self-coating yarn is utilized in every fill.

The fabric may be formed in accordance with several weaving patterns as illustrated in FIGS. 1–3. In each embodiment, the warp yarns are effect yarns and are preferably acrylic. In FIG. 1, while the warp yarns 10 are all acrylic, in the fill direction, acrylic yarns 12 are alternated with the self-coated composite yarns 14 (1×1 pattern insertion). This is considered to be a pattern insertion which results in 2.5–12.5% low melt constituent and yields a sturdy bond and a full body hand.

In FIG. 2, a 1×2 pattern insertion is utilized wherein there is one composite yarn 14 for every two picks of acrylic yarns 12. This results in 1.25–6.25% low melt constituent and yields a light bond and the softest hand.

In FIG. 3, there is illustrated a pattern in which the composite yarns are inserted in 100% of the fills. This pattern results in 5–25% low melt constituent and yields a hard bond and a firm hand.

In the table below, several different samples have been subjected to comparison testing to illustrate the differences in abrasion, seam slippage, and raveling of fabrics formed with the yarns of the present invention. In each sample, samples of the fabric are woven with conventional yarns in the warp direction. Each example differs slightly.

Sample 1 utilizes acrylic as the effect yarn and a stabilizing yarn combining polypropylene as the high melt constituent and polyethylene as the low melt constituent. Two filaments of polypropylene are air textured around a core of the polyethylene filament. Acrylic is used as the warp yarns and the polypropylene/polyethylene stabilizing yarn is used with acrylic fill yarns in a 1×1 insertion pattern.

Sample 2 is an all acrylic yarn weave construction back coated with latex.

Sample 3 is also an all acrylic yarn weave construction, but is not back coated.

Sample 4 utilizes acrylic as the effect yarn and a stabilizing yarn formed of 90% high melt acrylic fibers and 10% low melt polyethylene fibers. The high melt and low melt fibers are blended according to conventional blended yarn forming practices. Then the 90/10 blended stabilizing yarn is inserted at every pick.

Sample 5 is similar to Sample 1 except the polypropylene/polyethylene stabilizing yarn is used in each pick of the fill.

Sample 6 is made exactly as Sample 5, except the testing of the fabric occurred before heat setting.

| | Abrasion | Seam Slippage | Raveling |
|---|---|---|---|
| Sample #1 | W - 15,000<br>F - 15,000 | 100+ lbs. | Excellent |
| Sample #2 | W - 25,000<br>F - 25,000 | 76.2 | Excellent |
| Sample #3 | W - 3000<br>F - 15,000 | 29.6 lbs. | Poor |
| Sample #4 | W - 6000<br>F - 15,000 | 39.6 lbs. | Good |
| Sample #5 | W - 15,000<br>F - 15,000 | 100+ lbs. | Excellent |
| Sample #6 | W - 3000<br>F - 12,000 | 35 lbs | Poor |

As can be seen, samples 1, 2, 4, and 5 provide the best results. Sample 3, which utilizes conventional fill yarns without the self-coating yarns, exhibit relatively poor abrasion resistance, seam slippage, and raveling results. Sample 6 illustrates the importance of cross-flow which results from heat setting, as in Sample 5.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the pending claims and their equivalents.

What is claimed is:

1. Decorative fabric for use in outdoor environments comprising:

a. a woven structure of warp and fill yarns.

b. said warp yarns being high melt effect yarns selected from the group consisting of acrylic, polyester, olefin, and nylon and having a denier of at least 50 d.

c. at least some of said fill yarns being stabilizing yarns having a denier of at least 400 d and formed of both high-melt and low-melt yarn constituents.

(i) said low-melt constituents having a melt temperature below the temperature to which said fabric is subjected during tentering;

(ii) said high melt constituents having a melt temperature above the temperature to which said fabric is subjected during tentering;

(iii) whereupon said low-melt constituents melt and cross-flow to other fibers in said fill and warp yarns, d. whereby said fabric achieves enhanced abrasion resistance, stability, resistance to seam slippage, and load recovery without the need for a latex backing.

2. The fabric according to claim 1 having an abrasion resistance equal to or exceeding 9,000 double rubs.

3. The fabric according to claim 1 having the ability to resist seam slippage at forces of 40 lbs. and above.

4. The fabric according to claim 1 having a load recovery of at least 95%.

5. An outdoor fabric formed of warp yarns selected from the group consisting of acrylic, polyester, olefins and nylon, said fabric having an abrasion resistance equal to or exceeding 9,000 double rubs; seam slippage of at least 40 lbs.; and load recovery of at least 95%.

6. The fabric according to claim 1 wherein said woven structure includes a fill insertion ratio of stabilizing yarns to effect yarns selected from the group consisting of 1:1; 1:2; and 100% stabilizing yarns.

7. The fabric according to claim 1 wherein the melt temperature of said low-melt constituents is in the range of 240–280° F.

8. The fabric according claim 6 wherein the melt temperature of said high-melt constituents is in the range of 300–340° F.

9. The fabric according to claim 1 wherein the low-melt yarn constituent of said stabilizing yarn is selected from the group containing polyethylene, polypropylene, and low-melt olefins and the high-melt yarn constituent of said stabilizing yarn is selected from the group containing polyester, nylon and high-melt olefins.

10. The fabric of claim 1 wherein said stabilizing yarns are composite yarns having a low-melt core combined with at least one end of a high melt yarn.

11. The fabric of claim 9 wherein the amount of said low-melt constituent is said stabilizing yarns is in the range of 10%–50% of the weight of the yarn.

12. The fabric of claim 1 wherein said stabilizing yarns are blended yarns having low-melt fibers blended with high-melt fibers.

13. The fabric of claim 11 wherein said stabilizing yarns are composite yarns having a low-melt core combined with at least one end of a high-melt yarn.

* * * * *

UNITED STATES PATENT AND TRADEMARK OFFICE

CERTIFICATE OF CORRECTION

PATENT NO. : 6,161,596
DATED : December 19, 2000
INVENTOR(S) : David N. Swers; Johnny E. Parrish It is certified that error appears in the above-identified patent and that said Letters Patent is hereby corrected as shown below:

Column 5, claim 1,
Line 15, please correct "50 d" to --150d--.

Signed and Sealed this

Tenth Day of July, 2001

*Attest:*

Nicholas P. Godici

*Attesting Officer*

NICHOLAS P. GODICI
*Acting Director of the United States Patent and Trademark Office*